US007674094B2

(12) United States Patent
Yeh et al.

(10) Patent No.: US 7,674,094 B2
(45) Date of Patent: Mar. 9, 2010

(54) ELECTRIC FAN WITH SEALING LID

(75) Inventors: Chin-Wen Yeh, Tu-Cheng (TW); Chin-Long Ku, Tu-Cheng (TW); Hsieh-Kun Lee, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 809 days.

(21) Appl. No.: 11/309,687

(22) Filed: Sep. 12, 2006

(65) Prior Publication Data

US 2008/0063527 A1 Mar. 13, 2008

(51) Int. Cl.
*F04D 29/063* (2006.01)

(52) U.S. Cl. ..... 416/174; 415/175; 415/220; 415/229; 415/230; 417/423.13; 310/90; 384/100; 384/249; 384/903

(58) Field of Classification Search ..... 415/111–113, 415/175, 220, 222, 223, 229–231; 416/174; 310/67 R, 90; 417/423.12, 423.13; 384/100, 384/107, 121, 249, 903
See application file for complete search history.

(56) References Cited

U.S. PATENT DOCUMENTS 4,363,631 A * 12/1982 Wloka ..... 415/230
6,267,567 B1 * 7/2001 Hsieh ..... 417/423.12
6,400,054 B1 * 6/2002 Horng ..... 310/67 R
6,726,450 B2 4/2004 Lee et al.
6,756,714 B2 * 6/2004 Alex et al. ..... 310/90
2004/0234398 A1 * 11/2004 Hu et al. ..... 417/423.12
2006/0171826 A1 * 8/2006 Wu et al. ..... 417/423.13
2007/0257571 A1 * 11/2007 Hong et al. ..... 310/67 R

FOREIGN PATENT DOCUMENTS

TW 492520 Y 6/2002

* cited by examiner

*Primary Examiner*—Christopher Verdier
(74) *Attorney, Agent, or Firm*—Frank R. Niranjan

(57) ABSTRACT

An electric fan includes a fan base (10), a bearing (40) and a rotor assembly (20). The fan base forms a central tube (11) receiving the bearing therein. The rotor assembly includes a fan hub (22), and a pivot axle (23) joined to the fan hub. The pivot axle pivotably extends into the bearing. A sealing lid (60) is screwedly mounted on a bottom opening of the central tube to prevent lubricant oil contained in the central tube from leaking. The sealing lid abuts against a bottom of the bearing to prevent the bearing from deflection.

17 Claims, 6 Drawing Sheets

ELECTRIC FAN WITH SEALING LID

FIELD OF THE INVENTION

The present invention relates generally to an electric fan with a rotor assembly and a bearing, and more particularly to an electric fan having a sealing lid abutting against the bearing to prevent leakage of lubricant oil and prevent the bearing from deflection.

DESCRIPTION OF RELATED ART

As ICs (integrated circuits) such as computer CPUs (central processing units) are being designed to run faster and faster, more and more heat is being generated by these ICs. Electric fans are typically used to dissipate the heat generated by these ICs.

Referring to FIG. 6, a related fan 90 includes a fan base 91, a stator assembly 92 and a rotor assembly 93 pivotable with respect to the stator assembly 92. A bearing 94 is secured within a sleeve 95 of the stator assembly 92 and is used to pivotably support a pivot axle 96 of the rotor assembly 93. A sealing lid 80 is mounted on a bottom of the sleeve 95. Lubricant oil is stored in a space 82 surrounded by the sealing lid 80 and the sleeve 95. The pivot axle 96 extending in the space 82 defines an annular recess 97 in a distal end thereof. A locking ring 98 is engaged in the recess 97 for holding the rotor assembly 92 in the fan 90.

In the related fan 90, the sealing lid 80 is manually inserted in the bottom of the sleeve 95. The force exerted to insert the sealing lid 80 is varied and not predetermined. Sometimes the force is too large, which deforms or even damages the sealing lid 80. Furthermore, the sealing lid 80 is made of rubber. When the fan 90 is operated at high speed, large amounts of heat are generated, which results in that the sealing lid 80 is prone to deformation and aging; in addition, the sealing lid 80 cannot provide an axial support to the bearing 94, whereby the bearing 94 is likely to deform and generate noise when the rotor assembly 93 rotates.

Therefore, it is desirable to provide a fan having a sealing lid which overcomes the foregoing disadvantages.

SUMMARY OF THE INVENTION

According to a preferred embodiment of the present invention, an electric fan includes a fan base, a bearing and a rotor assembly. The fan base forms a central tube receiving the bearing therein. The rotor assembly includes a fan hub, and a pivot axle rotatably joined to the bearing in the fan hub. The pivot axle pivotably extends through the bearing. A sealing lid is screwedly mounted on a bottom opening of the central tube to prevent lubricant oil contained in a bottom of the central tube from leaking. The sealing lid abuts against a bottom of the bearing to prevent the bearing from deflection.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present device can be better understood with reference to the following drawings. The components in the drawings are not necessarily drawn to scale, the emphasis instead being placed upon clearly illustrating the principles of the present device. Moreover, in the drawings, like reference numerals designate corresponding parts throughout the several views.

DETAILED DESCRIPTION OF THE INVENTION

Figure 1:
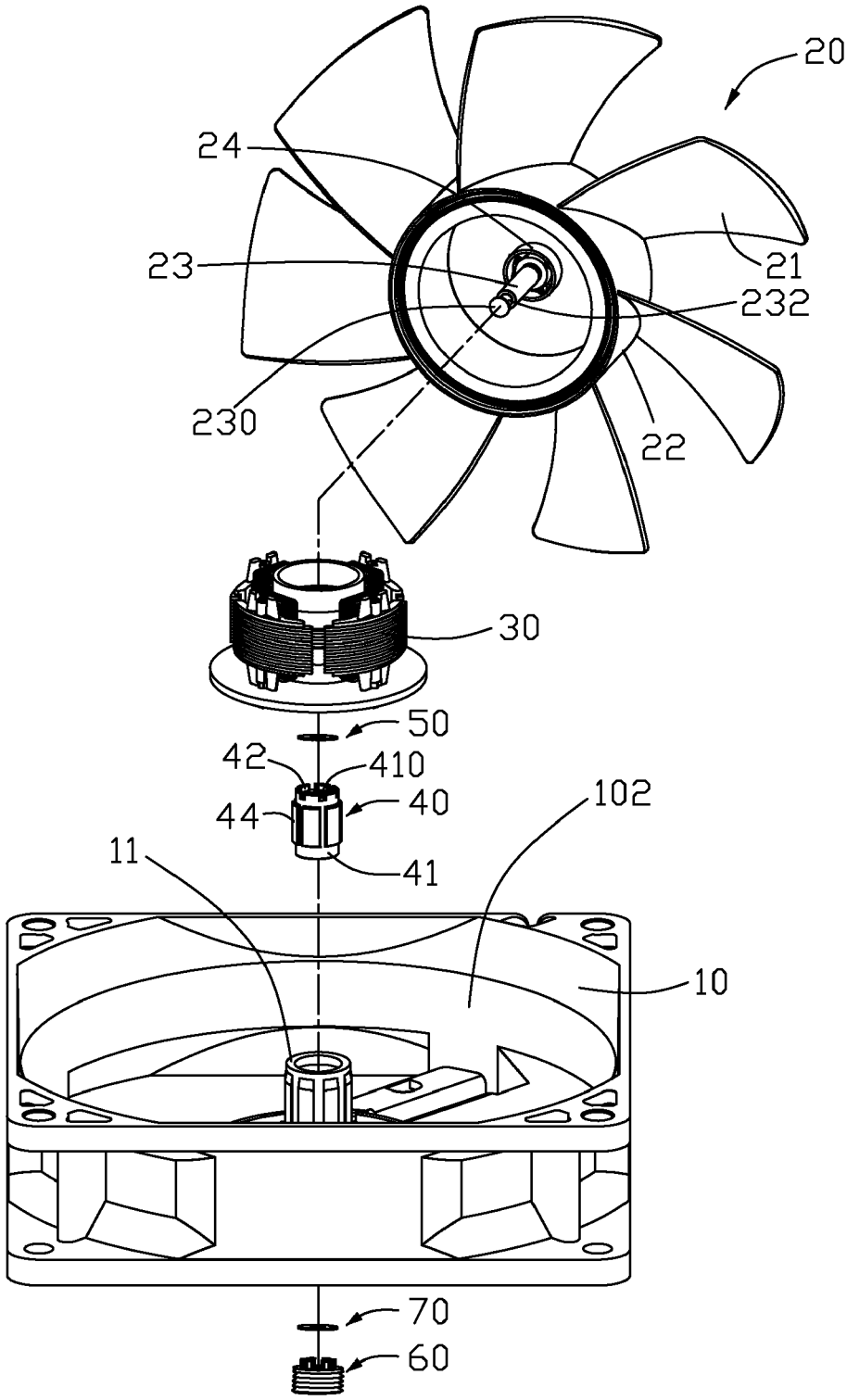
FIG. 1 is an exploded, isometric view of an electric fan in accordance with a preferred embodiment of the present invention.
Figure 2:
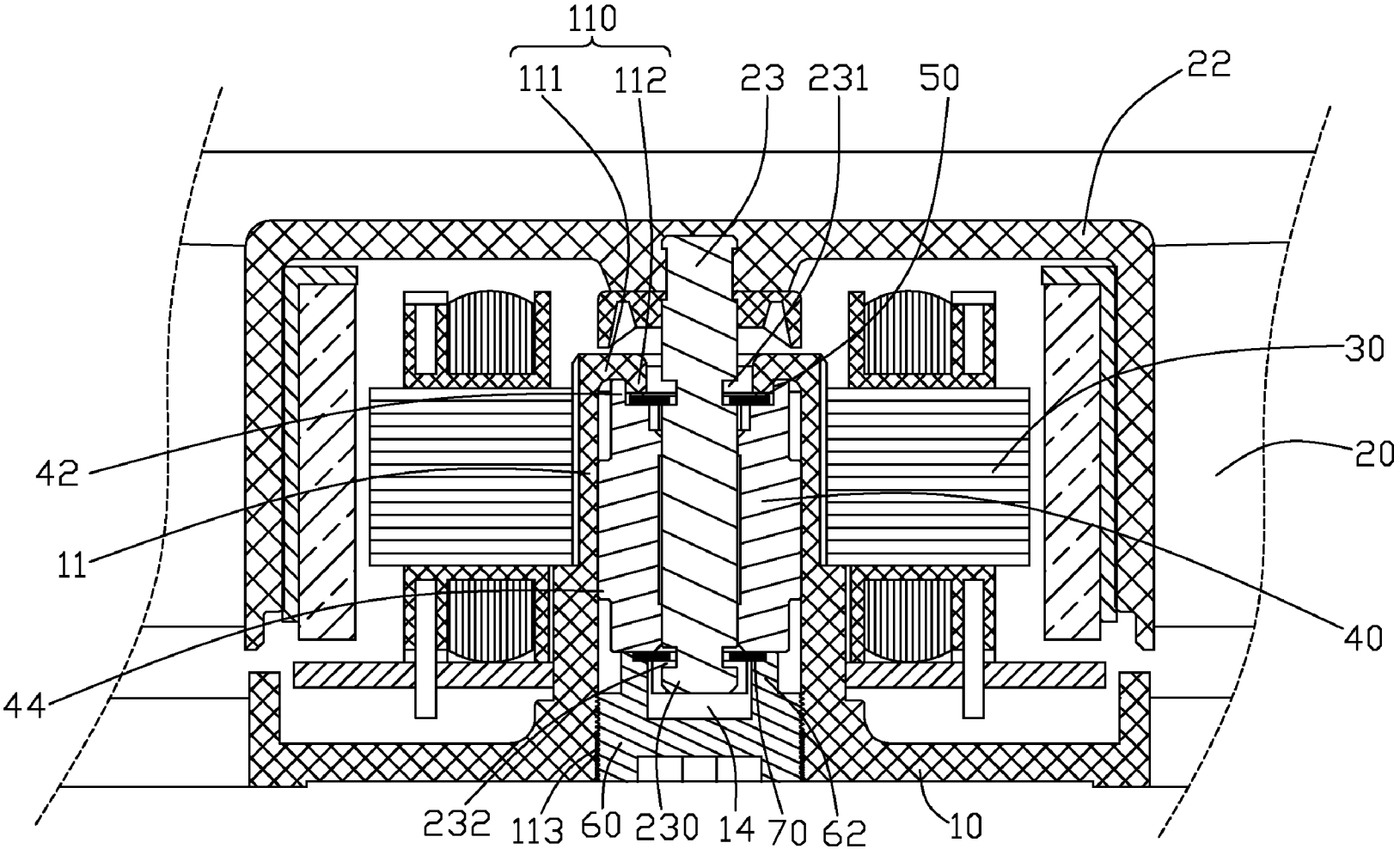
FIG. 2 is an assembled, cross-sectional view of the electric fan of FIG. 1.

FIGS. 1-2 illustrate by way of example an electric fan in accordance with a preferred embodiment of the present invention. The fan comprises a fan base 10, a rotor assembly 20, a stator assembly 30, a bearing 40, and a sealing lid 60 mounted on a bottom end of the bearing 40 for preventing leakage of lubricant oil and axially supporting the bearing 40. The rotor assembly 20 is pivotable with respect to the stator assembly 30.

The fan base 10 defines a cavity 102 for receiving the rotor assembly 20 and the stator assembly 30 therein. A central tube 11 is formed at a central portion of the fan base 10. The central tube 11 has a hollow and cylindrical configuration. The bearing 40 is engagingly received in an opening (not labeled) of the central tube 11. The stator assembly 30 is attached around the central tube 11. A baffle element 110 bends from a top of a circumferential wall (not labeled) of the central tube 11 and engages with the bearing 40 so as to prevent lubricating oil from leaking from a top end of the bearing 40. The baffle element 110 comprises an annular connecting portion 111 extending perpendicularly, horizontally and inwardly from a top of the circumferential wall of the center tube 11 and a leg 112 extending perpendicularly and downwardly from an inner end of the connecting portion 111. A lubricant reservoir 14 is formed in the fan base 10 below the bearing 40 and above the sealing lid 60, which supplies the lubricant oil to the bearing 40 when the fan is operated. The sealing lid 60 is mounted on a bottom of the opening of the central tube 11. An inner surface of the bottom opening of the central tube 11 corresponding to the sealing lid 60 forms a plurality of internal threads 113.

The rotor assembly 20 comprises a generally cup-like fan hub 22 having a top wall (not labeled) and a periphery wall (not labeled) extending downwardly from a circumference of the top wall. A plurality of fan blades 21 are formed around the periphery wall of the fan hub 22. An axle seat 24 is formed on a center of the top wall. A pivot axle 23 extends perpendicularly downwards from the top wall of the fan hub 22 and has an upper portion surrounded by the axle seat 24. A first annular slot 231 positioned corresponding to a top of the bearing 40 is defined in an upper portion of the pivot axle 23 for receiving a first locking ring 50. The first locking ring 50 is sandwiched between a top of the bearing 40 and a bottom of the leg 112 of the baffle element 110. The pivot axle 23 is formed with a semispherical bottom end 230. A second annular slot 232 is defined in a lower portion of the pivot axle 23 in the vicinity of the bottom end 230 and positioned corresponding to a bottom of the bearing 40, for receiving a second locking ring 70. The first and second locking rings 50, 70 located at two opposite ends of the bearing 40 can hold the rotor assembly 20 in position in respective to an axial direction thereof, thereby preventing the rotor assembly 20 from escaping from the bearing 40. Simultaneously, the first locking ring 50 located between the top of the bearing 40 and the leg 112 of the baffle element 110 can prevent the lubricant oil from leaking from a gap between the leg 112 of the baffle element 110 and the pivot axle 23.

Figure 3:
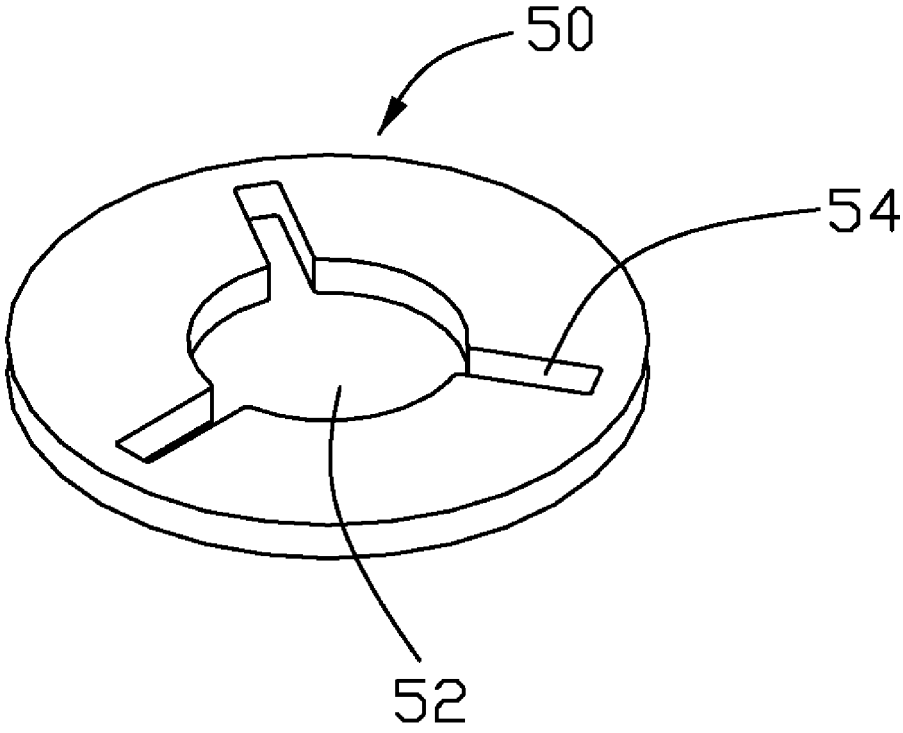
FIG. 3 is an enlarged and isometric view of a locking ring of the electric fan of FIG. 1.

Referring to FIG. 3, the first locking ring 50 has a plate-like configuration. The first locking ring 50 defines a central bore 52 therein. The central bore 52 has a diameter smaller than that of the pivot axle 23 at a middle portion thereof and larger than that of the pivot axle 23 at the first annular slot 231. A plurality of elongated slots 54 communicating with the central bore 52 are defined radially extending from the central bore 52 for providing elasticity to the first locking ring 50, whereby the pivot axle 23 can extend through the central bore 52 to reach a position in which an inner edge portion (not labeled) of the first locking ring 50 around the central bore 52 extends into the first annular slot 231. The second locking ring 70 has the same configuration as the first locking ring 50.

The bearing 40 has a cylindrical shape, and has a cylindrical outer wall 41. A central hole 410 is defined in a central portion of the bearing 40 for receiving the pivot axle 23 therein. A plurality of evenly spaced protrusions 42 extend upwardly from a top end of the outer wall 41 for engaging with a bottom of the connecting portion 111 of the baffle element 110. A plurality of evenly spaced bulwarks 44 corresponding to the protrusions 42 are circumferentially formed on the outer wall 41 for abutting against an inner surface of the central tube 11.

Figure 4:
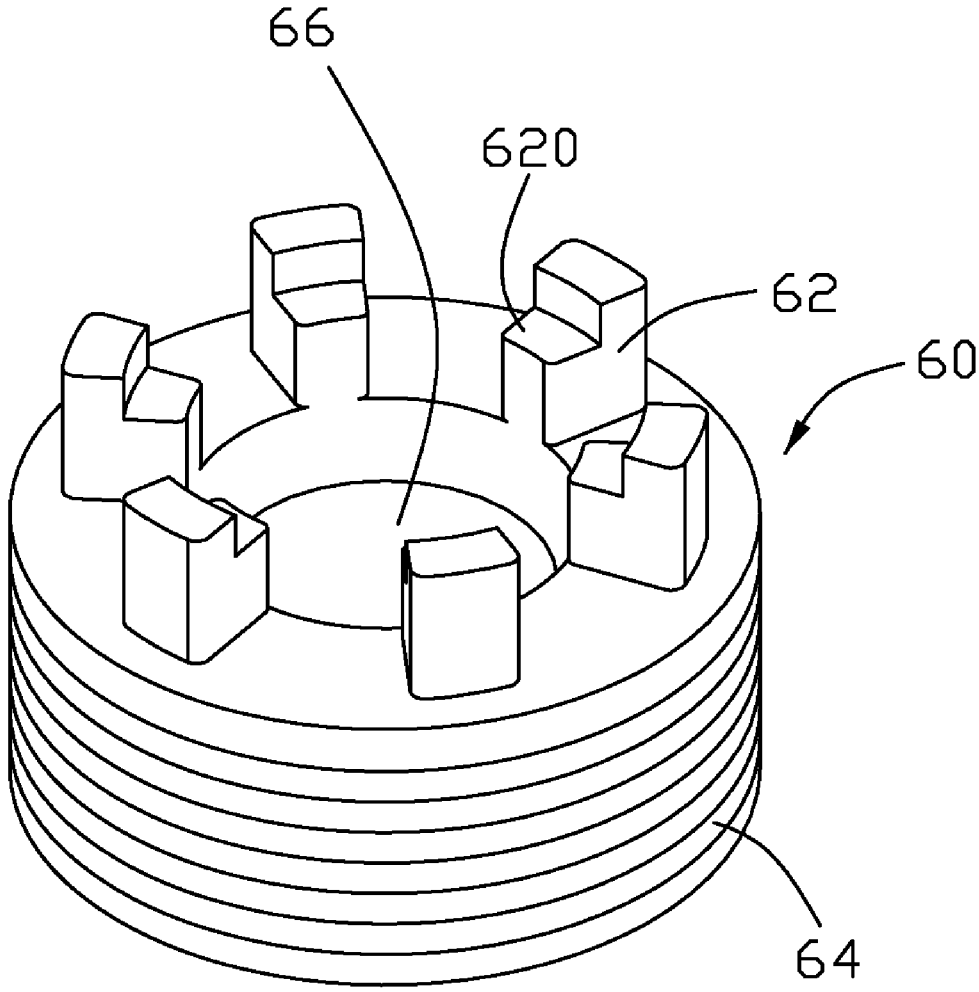
FIG. 4 is an enlarged and isometric view of a sealing lid of the electric fan of FIG. 1.
Figure 5:
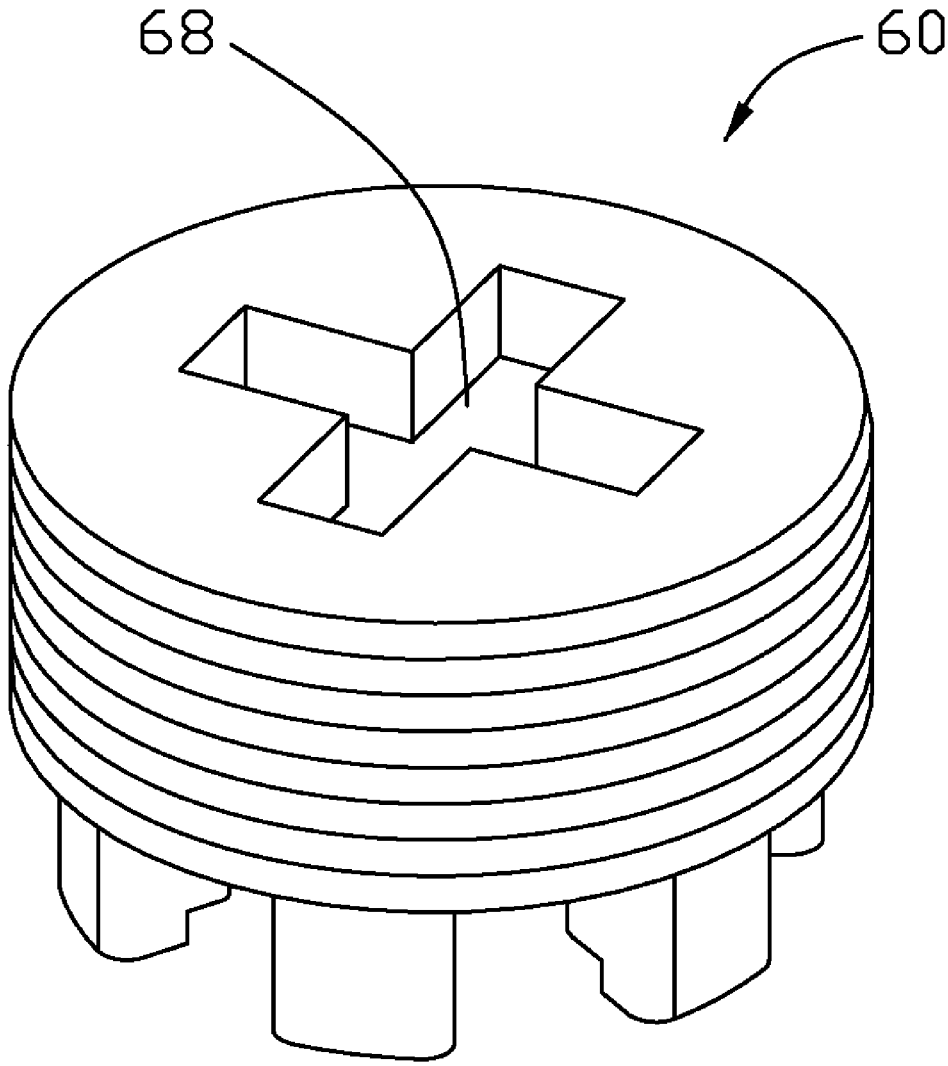
FIG. 5 is a view similar to FIG. 5, but shown from an opposite bottom aspect.
Figure 6:
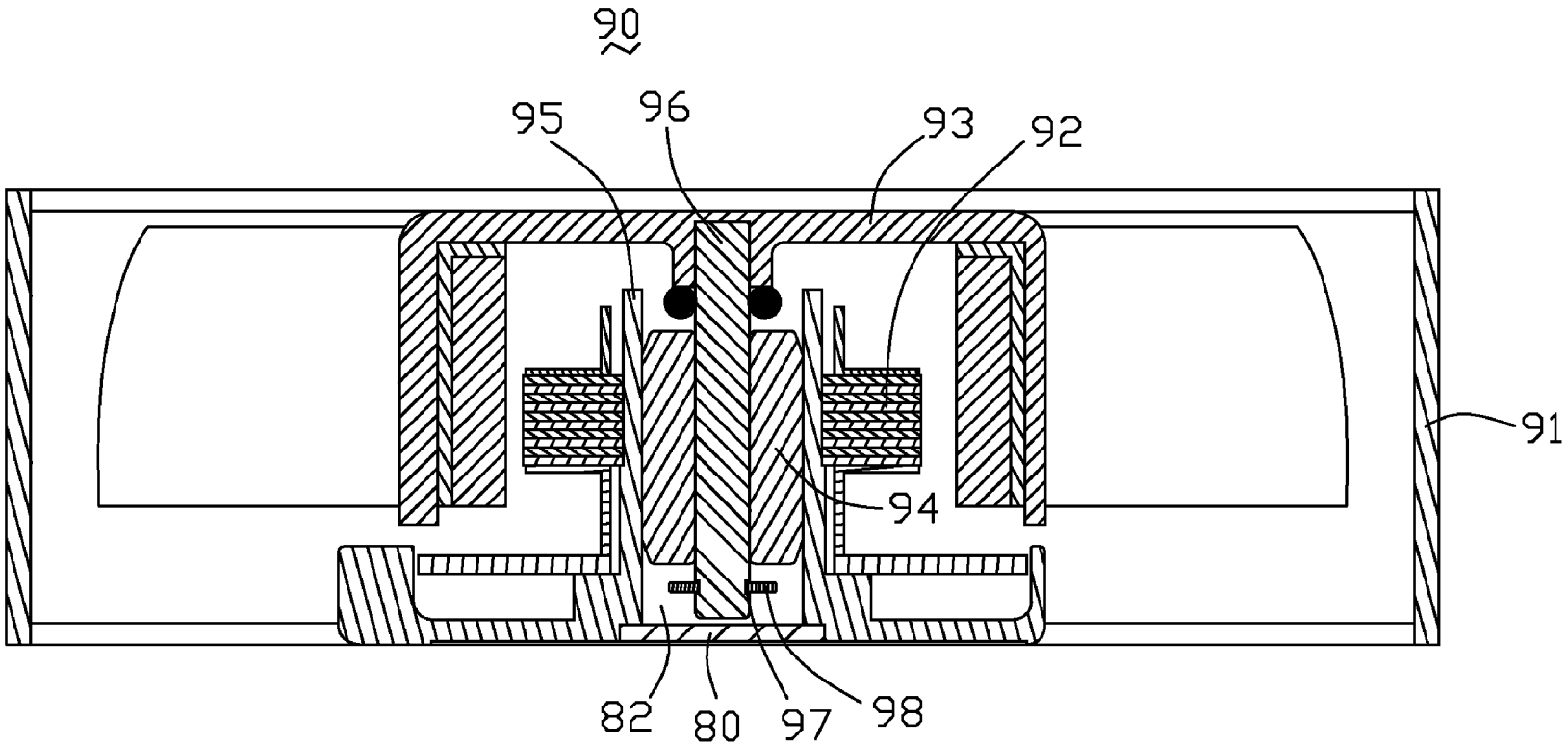
FIG. 6 (PRIOR ART)
FIG. 6 is a cross-sectional view of an electric fan in accordance with related art.

Referring to FIGS. 2 and 4, the sealing lid 60 has a cylindrical configuration and is made of plastic material. The sealing lid 60 forms a plurality of protruding blocks 62 extending upwardly from a circumferential portion of a top thereof. The protruding blocks 62 are evenly spaced. The protruding blocks 62 abut against a bottom of the bearing 40 for supporting the bearing 40, thereby preventing the bearing 40 from becoming deflection from its original position as the fan is operated. A step 620 is formed at an inner side of each protruding block 62. These steps 620 are used for supporting the second locking ring 70 thereon. An inner space 66 is defined at an upper portion of the sealing lid 60 for accommodating the bottom end 230 of the pivot axle 23 therein. The second locking ring 70 is sandwiched between the bottom of the bearing 40 and the steps 620 of the protruding blocks 62 of the sealing lid 60. A plurality of external threads 64 are formed on an outer circumferential surface of the sealing lid 60 for engaging the internal threads 113 of the central tube 11 of the fan base 10. A bottom of the sealing lid 60 defines two perpendicularly intersecting slots 68 (shown in FIG. 5) for receiving a screwdriver (not shown) to facilitate assembly of the sealing lid 60 to the bottom of the central tube 11 of the fan.

In the present invention, the sealing lid 60 is screwedly connected to the bottom of the central tube 11; as a result, the sealing lid 60 will not slide off from the fan so that a risk of leakage of the lubricant oil can be avoided. Furthermore, the sealing lid 60 abuts against the bottom of the bearing 40 and the baffle element 110 abuts against the protrusions 42 extending from the top of the bearing 40 so that a problem of a deflection of the bearing 40 can be lessened, in comparison with the related art fan when the fans are operated at high speed. Finally, a pneumatic screwdriver (not shown) which can exert a predetermined force (torque) can be used to screw the sealing lid 60 to the bottom of the central tube 11 to threadedly connect the sealing lid 60 with the internal threads 113; thus, the assembly of the sealing lid 60 with the fan can be quickly completed under a uniform quality. The assembling force exerted on the sealing lid 60 is even.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric fan comprising:

a fan base comprising a central tube;

a bearing received in the central tube;

a rotor assembly comprising a fan hub, and a pivot axle joined to the fan hub and pivotably extending through the bearing; and a sealing lid screwedly mounted on a bottom opening of the central tube to prevent lubricant oil contained in a bottom of the central tube from leaking, the sealing lid abutting against a bottom of the bearing to support the bearing in position;

wherein the sealing lid comprises a plurality of protruding blocks extending upwardly from a top of the sealing lid, the protruding blocks abutting against the bottom of the bearing.

2. The electric fan of claim 1, wherein the sealing lid has a cylindrical configuration.

3. The electric fan of claim 2, wherein an inner surface of the bottom opening of the central tube corresponding to the sealing lid forms a plurality of internal threads.

4. The electric fan of claim 3, wherein a plurality of external threads are formed on an outer circumferential surface of the sealing lid for engaging the internal threads of the central tube of the fan base.

5. The electric fan of claim 1, wherein a bottom of the sealing lid defines two perpendicularly intersecting slots for receiving a screwdriver to facilitate assembly of the sealing lid to the central tube.

6. The electric fan of claim 1, wherein a step is formed at an inner side of each protruding block.

7. The electric fan of claim 6, wherein first and second locking rings are located at two opposing ends of the bearing for preventing the rotor assembly from escaping from the bearing when the fan is operated.

8. The electric fan of claim 7, wherein the first locking ring is located at an upper portion of the pivot axle and the second locking ring is located at a lower portion of the pivot axle.

9. The electric fan of claim 7, wherein the second locking ring is sandwiched between the bottom of the bearing and the steps of the protruding blocks.

10. The electric fan of claim 8, wherein the sealing lid defines an inner space at an upper portion thereof for accommodating a bottom end of the pivot axle in the sealing lid.

11. The electric fan of claim 7, wherein the central tube comprises a periphery wall and a baffle element bent from a top end of the periphery wall, and the baffle element engages with upper protrusions of the bearing.

12. The electric fan of claim 10, wherein the baffle element comprises a connecting portion extending perpendicularly and inwardly from the top of the periphery wall of the central tube and a leg extending downwardly from an inner end of the connecting portion.

13. The electric fan of claim 12, wherein the first locking ring is sandwiched between a top of the bearing and a bottom of the leg of the baffle element.

14. The electric fan of claim 13, wherein the upper protrusions of the bearing engage with a bottom of the connecting portion of the baffle element.

15. The electric fan of claim 1, wherein a plurality of evenly spaced bulwarks are circumferentially formed on an outer wall of the bearing for abutting against an inner surface of the central tube.

16. An electric fan comprising:

a fan base forming a central tube;

a stator assembly mounted around the central tube;

a rotor assembly having a hub, a plurality of blades extending radially outwardly from the hub, and a pivot axle extending downwardly from the hub;

a bearing received in the central tube wherein the pivot axle rotatably fitting through the bearing; and a sealing lid secured to a bottom end of the central tube to seal a bottom opening of the central tube;

wherein the sealing lid comprises a plurality of protruding blocks extending upwardly from a top of the sealing lid, the protruding blocks abutting against a bottom of the bearing.

17. The electric fan of claim 16, wherein the sealing lid is screwed to the bottom end of the central tube.

* * * * *